United States Patent [19]

Vakil

[11] 4,384,460

[45] May 24, 1983

[54] MEANS AND METHOD FOR MODULATING AND CONTROLLING THE CAPACITY OF A VAPOR COMPRESSION CYCLE DEVICE

[75] Inventor: Himanshu B. Vakil, Schenectady, N.Y.

[73] Assignee: General Electric Company, Schenectady, N.Y.

[21] Appl. No.: 98,634

[22] Filed: Nov. 29, 1979

[51] Int. Cl.[3] ..... F25B 45/00

[52] U.S. Cl. ..... 62/114; 62/149; 62/174

[58] Field of Search ..... 62/114, 115, 174, 503, 62/512, 149

[56] References Cited

U.S. PATENT DOCUMENTS

| | | | |
|---|---|---|---|
| 2,794,328 | 6/1957 | Herrick | 62/115 |
| 2,938,362 | 5/1960 | Schwind | 62/149 |
| 2,951,350 | 9/1960 | Etherington et al. | 62/149 |
| 3,500,656 | 3/1970 | Lofgreen | 62/196 |
| 4,179,898 | 12/1979 | Vakil | 62/114 |

*Primary Examiner*—Albert J. Makay
*Assistant Examiner*—Henry Bennett
*Attorney, Agent, or Firm*—William A. Teoli; James C. Davis, Jr.

[57] ABSTRACT

Adjustments in working fluid mixture composition directly effecting the capacity of an associated vapor compression cycle device are achieved by varying the inventory of mixture stored in a device high-pressure accumulator through the controlled regulation of the accumulator pressure.

16 Claims, 3 Drawing Figures

14
15
6
16
18
2
8
7
17
3
V
1
4
5

15
6
14
16
18
19
2
7
17
V
3

11
9
V
6
15
14
16
7
2
18
17
13
12
10
3

MEANS AND METHOD FOR MODULATING AND CONTROLLING THE CAPACITY OF A VAPOR COMPRESSION CYCLE DEVICE

BACKGROUND OF THE INVENTION

This invention relates to vapor compression cycle devices of variable capacity and, more particularly, to a means and a method for controlling the capacity modulation of a vapor compression cycle device.

To better accommodate varying heating or cooling demands, a vapor compression cycle device should be provided with a means to vary its capacity. Several methods have been disclosed which enable such a capacity modulation, including the method disclosed in copending patent application Ser. No. 926,510, filed July 20, 1978, now U.S. Pat. No. 4,217,760 and assigned to the assignee hereof. This particular approach utilizes the thermodynamic properties of certain multi-component working fluid mixtures in a two accumulator device to enable the variation of the capacity of that device. The present invention discloses an improved means and method for controlling the capacity modulation of a device of this type.

Capacity modulation in devices such as that disclosed in U.S. Pat. No. 4,217,760 is achieved by exploiting certain thermodynamic equilibrium properties between interfacing liquid and vapor phases of a miscible multi-component working fluid mixture. In particular, advantage is derived from the fact that the density of mixture vapor is a function of the composition of an interfacing mixture liquid. Accordingly, by connecting a compressor suction line of a device with an accumulator in which a charge of mixture liquid is maintained, changes in the composition of the liquid will have a direct affect on the density of the vapor entering the compressor, and thus can directly affect the device capacity. The composition of this liquid is in turn varied by regulating the flow rate of mixture liquid from a high pressure accumulator of the device, which liquid typically has a different composition than does the liquid contained in a low pressure accumulator.

Control of the mixture liquid flow rate from the high pressure accumulator, and thus control over device capacity modulation, has typically been accomplished through the use of an adjustable flow-restricting device located in a flow path intermediate the high and low pressure accumulators. Although this is an effective control system, a simpler, more dependable and less costly control system would be preferable in many applications, such as in refrigerators. Accordingly, the present invention is an improvement over prior variable capacity vapor compression cycle devices of this type in that it provides a simplified, dependable control system.

Additionally, the present invention may beneficially extend the lifetime of compressors which have previously been adversely affected in conventional vapor compression cycle devices by high startup loads following periods of inoperation, such as after defrost cycles in refrigerator applications. The present invention as described hereinbelow achieves a decrease in compressor startup load by storing additional working fluid in a high pressure accumulator of the device prior to shutting off the system compressor. Thus, the compressor is confronted with a decreased load during a subsequent startup, thereby beneficially extending the lifetime of the compressor.

Accordingly, it is an object of the present invention to provide a new and improved vapor compression cycle device.

It is a further object of the present invention to provide a simplified means and method for controlling the capacity modulation of a vapor compression cycle device.

Still another object of the present invention is to extend the lifetime of a vapor compression cycle device compressor through a reduction of compressor startup loads.

SUMMARY OF THE INVENTION

The above and other objects and benefits are achieved in a means and a method for controlling the capacity modulation of a vapor compression cycle device. The pressure in a high-pressure accumulator of the device is regulated by varying the temperature of a multi-component working fluid mixture contained therein, causing mixture to either enter or leave the accumulator, thereby directly affecting the composition of the mixture liquid contained in a low pressure accumulator of the device. The variation of liquid composition in the low pressure accumulator affects the molar flow rate through a cooperating compressor and accordingly varies the capacity of the device. Similarly, the regulation of pressure in the high pressure accumulator enables the storage of additional mixture therein prior to device shutdown to provide a reduced load for the system compressor upon subsequent startup, whereby compressor lifetime may be beneficially extended.

BRIEF DESCRIPTION OF THE DRAWING

For a better understanding of the invention reference may be had to the accompanying drawing wherein.

DESCRIPTION OF THE INVENTION

A vapor compression cycle device according to the present invention includes a multi-component working fluid mixture circulated through a closed working fluid circuit. The working fluid mixture must be miscible over the operating temperature range of the device to enable the exploitation of the mixture thermodynamic properties noted above. Examples of suitable working fluid mixtures include the following: R-22 and R-114; R-13B1 and R-152A; and R-23, R-22 and R-114.

Figure 1:
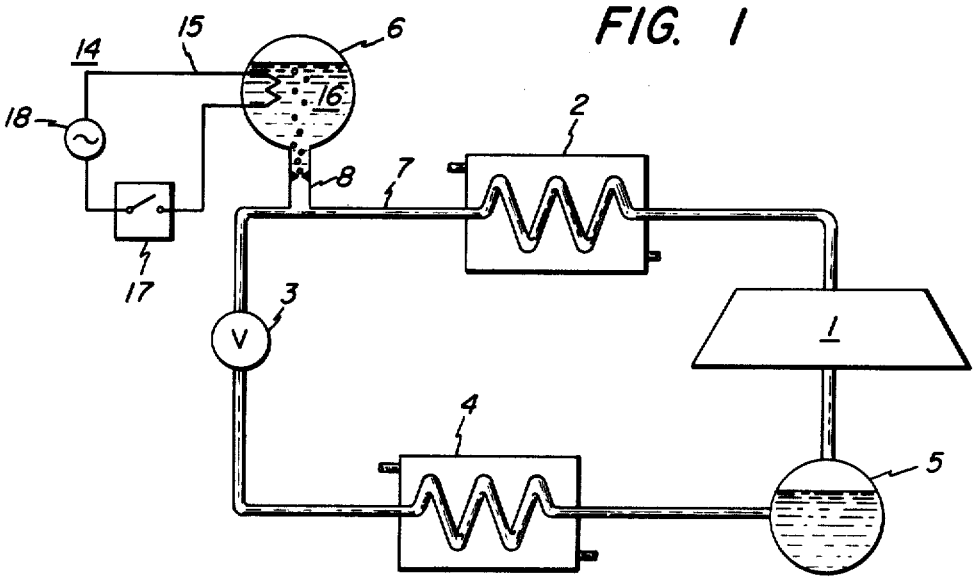
FIG. 1 is a schematic representation of a vapor compression cycle device constructed in accordance with an embodiment of the invention.

The working fluid circuit of the device includes an operating segment and a storage segment. As illustrated in FIG. 1, an operating segment typically includes a compressor 1 connected in series with a condensing heat exchanger 2 and a flow restricting device 3. An evaporating heat exchanger 4 and an associated low pressure accumulator 5 are connected in flow communication intermediate the flow restricting device 3 and the compressor 1. Although depicted as following the evaporating heat exchanger 4, it is understood that the low pressure accumulator 5 may be positioned within the evaporator 4 as disclosed in copending patent application Ser. No. 052,971, filed June 28, 1979, and assigned to the assignee hereof. However, in either arrangement, the suction line of the compressor 1 is in flow communication with a vapor bearing portion of the low pressure accumulator 5.

The storage segment of the device working fluid circuit includes a high pressure accumulator 6 connected to the operating segment of the working fluid circuit. In the embodiment depicted in FIG. 1, the high pressure accumulator 6 is connected to a vapor bearing portion of the working fluid circuit operating segment. In particular, the accumulator 6 may be in vapor communication with a line 7 connecting the outlet of the condensing heat exchanger 2 and the flow restricting device 3. The storage segment of the device illustrated in FIG. 1 also includes a liquid flow restricting device 8 which is adapted to allow vapor to flow into the accumulator 6 while restricting the flow of liquid out of the accumulator. In the embodiment illustrated in FIG. 1, the flow restricting device 8 is a sufficiently necked down portion of a tube connecting the accumulator 6 with the line 7.

Figure 2:
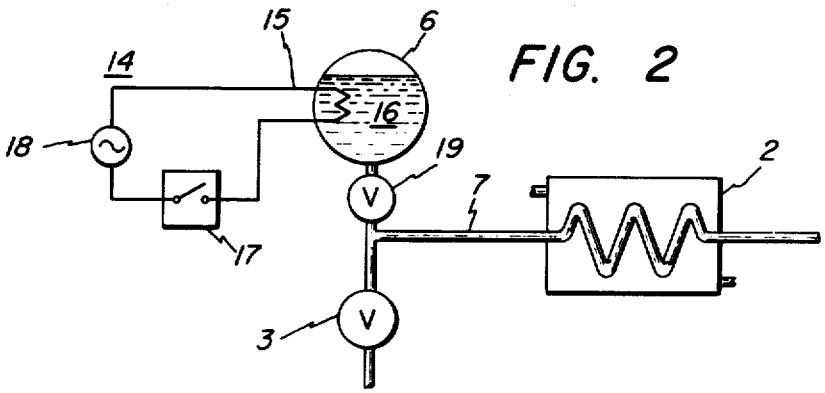
FIGS. 2 and 3 are schematic representations of portions of vapor compression cycle devices constructed in accordance with alternative embodiments of the invention, which portions vary markedly from the otherwise similar device depicted in FIG. 1.
Figure 3:
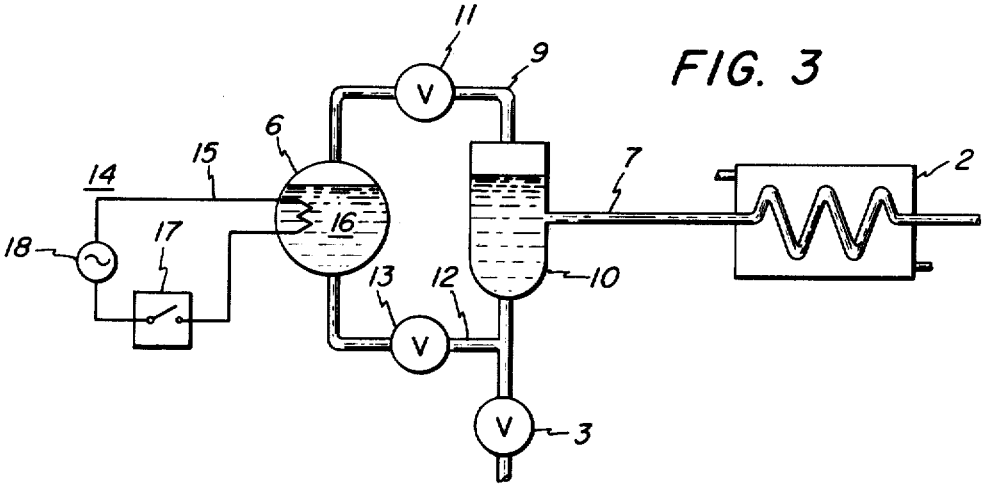

In the embodiments of the invention depicted in FIGS. 2 and 3 the storage segment of the working fluid circuit also includes an accumulator 6. However, in the embodiment depicted in FIG. 2, the accumulator 6 is in flow communication with a liquid bearing portion of the working fluid circuit operating segment, such as the line 7. Accordingly, the storage segment of the embodiment of FIG. 2 does not require a liquid flow restricting device as in the embodiment illustrated in FIG. 1.

The storage segment of the embodiment illustrated in FIG. 3 is similar to the high pressure accumulator of a vapor compression cycle device disclosed in copending patent application Ser. No. 929,339, filed Aug. 3, 1979, now U.S. Pat. No. 4,179,898 and assigned to the assignee hereof. In particular, the accumulator 6 is connected by an inlet 9 to a vapor bearing portion of the working fluid circuit which may include a vapor-liquid separator 10. The inlet 9 includes a unidirectional flow restricting device 11 which limits the flow of mixture out from the accumulator 6. The high pressure accumulator 6 in the embodiment of the invention depicted in FIG. 3 also includes an outlet 12 connecting a liquid bearing portion of the accumulator 6 with the operating segment of the working fluid circuit. Liquid flow restricting device 13 on the outlet line 12 limits the flow of mixture into the accumulator 6. Although the outlet line 12 is depicted in FIG. 3 as connected intermediate the condenser 2 and the flow restricting device 3 it is understood that the outlet 12 may be alternatively connected to the working fluid circuit operating segment at a point between the flow restricting device 3 and the compressor 1 provided a suitable liquid flow restricting device 13 is employed compatible with the decreased pressure characteristic of that portion of the working fluid circuit.

Pressure within the high pressure accumulator 6 is varied by a means 14. As depicted in the drawing, the means 14 preferably includes an electrical resistance heater 15 disposed in heat exchange relationship with a mixture storage portion 16 of the high pressure accumulator 6. The means for varying pressure in the high pressure accumulator 6 may also include a means for cooling disposed in heat exchange relationship with the mixture storage portion of the accumulator 6. In a typical refrigerator application, for example, the means for cooling may be provided by placing the high pressure accumulator in thermal contact with a refrigerated portion of the refreigerator.

The means for varying pressure in the high pressure accumulator 6 is selectively controlled by a means for sensing thermal demand 17. This demand sensing means 17 may be a conventional thermostat connected in series with an electric resistance heater 15 and an associated voltage supply 18.

In operation, the multi-component working fluid mixture in the device depicted in FIG. 1 is compressed in the compressor 1 and circulated through the condensing heat exchanger 2 where it is at least partially condensed. The mixture is transferred to the evaporating heat exchanger 4 after negotiating the flow restricting device 3. At least most of working fluid mixture is evaporated in the evaporating heat exchanger 4 and is circulated to the low pressure accumulator 5. Mixture liquid is maintained therein at a low pressure and in thermodynamic equilibrium with mixture vapor. The density of this vapor in the low pressure accumulator 5 is dependent upon the composition of the mixture liquid maintained therein. Similarly, since the compressor is in vapor communication with the low pressure accumulator 5, the molar flow rate through the compressor and thus the device capacity is also dependent upon the composition of the mixture liquid maintained in the low pressure accumulator 8.

Modulation of device capacity is accomplished through the addition or withdrawal of working fluid mixture from the storage segment of the working fluid circuit including the high pressure accumulator 6. Thus, in the embodiment depicted in FIG. 1, upon decreased demand as sensed by the thermostat 17 the electrical resistance heater 15 is inactivated and the temperature of the high pressure accumulator 6 drops steadily as a result of thermal contact with the cooling means. Consequently, the pressure inside the high pressure accumulator 6 drops below the prevalent pressure in the vapor bearing portion of the line 7, thereby causing mixture vapor to enter the accumulator due to the pressure differential. This vapor undergoes condensation in the accumulator 6 and is maintained as a liquid therein. The vapor transferred into the high pressure accumulator 6 is naturally enriched in a lower boiling point component of the working fluid mixture. Thus, the storage of this condensed vapor results in an alteration of the composition of the mixture flowing into the low pressure accumulator 5. This change is reflected in a change in mixture liquid composition in the accumulator 5 and in an associated decrease in vapor density therein and of the molar flow rate through the compressor 1.

Upon sensed increased demand by the thermostat 17 the electrical resistance heater is activated, heating the mixture contained in the accumulator 6 thereby causing the pressure to rise steadily in the accumulator 6 until sufficient pressure is generated to force an amount of mixture liquid out of the high pressure accumulator 6 and into the line 7. This liquid is enriched in the low boiling point component of the working fluid mixture, as noted above, and its addition thus causes a change in the composition of the liquid contained in the low pressure accumulator 5. More specifically, the liquid in the accumulator 5 is enriched in the low boiling point component of the working fluid mixture, causing an increase in vapor density therein and an associated increase in the molar flow rate through the compressor 1 resulting in an increase in device capacity.

The operation of the device depicted in FIG. 2 is similar to the operation of the device depicted in FIG. 1 as described above. However, since the liquid stored in the accumulator 6 in FIG. 2 is not condensed vapor as in the embodiment of FIG. 1, the liquid contained in the accumulator 6 of FIG. 2 is not as enriched in the low boiling point component of the working fluid mixture as is the liquid in the accumulator 6 of FIG. 1. Accordingly, the range of capacity modulation available in the device depicted in FIG. 2 is somewhat less than that available in the device depicted in FIG. 1.

In the embodiment of the invention depicted in FIG. 3 working fluid vapor and liquid are disassociated in the separator 10. During periods of decreased demand the pressure in the high pressure accumulator 6 is decreased by thermal contact with the cooling means resulting in a transfer of working fluid vapor into the accumulator 6 through the line 9 wherein it is condensed and stored. Upon increased demand as sensed by the means 17, the electrical resistance heater 15 is activated, thereby heating the stored mixture liquid and increasing the pressure in the accumulator 6. The flow of mixture out of the accumulator 6 through the line 9 is limited by the flow restricting device 11. Instead, mixture liquid is ejected into the working fluid circuit from the accumulator 6 through the line 12. As in the embodiment depicted in FIG. 1, the liquid ejected from the accumulator 6 is condensed mixture vapor which is naturally enriched in the low boiling point component of the mixture. Accordingly, as described above, the composition of the liquid contained in the low pressure accumulator 5 is varied resulting in an increase in device capacity.

In another mode of operation the present invention may be employed to decrease the compressor startup load following a period of inactivation. The pressure in the high pressure accumulator 6 is decreased as described hereinabove, resulting in the storage of additional mixture in the accumulator 6 and an associated decrease in compressor load. As depicted in FIG. 2, a valve 19 may be advantageously employed in the present invention to isolate the accumulator 6 during periods of inactivation. Upon restarting, the load on the compressor 1 is less than that normally encountered, and may be gradually increased to meet sensed demand through operation of the electrical resistance heater as noted above. This storage of working fluid has the additional benefit of lessening the risk of compressor lubricant degradation by decreasing the mixture inventory which might otherwise come into contact with the lubricant while the compressor is inoperative.

The above described embodiments of this invention are intended to be exemplative only and not limiting and it will be appreciated from the foregoing by those skilled in the art that many substitutions, alterations and changes may be made to the disclosed means and methods without departing from the spirit or scope of the invention.

What I claim as new and desire to secure by Letters Patent of the United States is:

1. A vapor compression cycle device comprising:

a closed working fluid circuit having an operating circuit and a storage segment, a miscible multi-component working fluid mixture in said circuit with said components having different boiling points, said working fluid circuit operating segment comprising, serially connected, a compressor in flow communication with a condensing heat exchanger in flow communication with a flow restricting device in communication with an evaporating heat exchanger in flow communication with a low pressure accumulator in flow communication with the input of said compressor, said working fluid circuit storage segment comprising a high pressure accumulator in fluid communication exclusively with said working fluid circuit operating segment intermediate said compressor and said flow restricting device, a means for varying the pressure in said high pressure accumulator and, a means for sensing thermal demand disposed to selectively control said pressure varying means.

2. A vapor compression cycle device comprising:

a closed working fluid circuit having an operating segment and a storage segment;

a miscible multi-component working fluid mixture in said circuit with said components having different boiling points;

said working fluid circuit operating segment comprising, serially connected, a compressor in flow communication with a condensing heat exchanger in flow communication with a flow restricting device in communication with an evaporating heat exchanger in flow communication with a flow pressure accumulator in flow communication with the input of said compressor, said working fluid circuit storage segment comprising a high pressure accumulator in fluid communication with said working fluid circuit operating segment intermediate said compressor and said flow restricting device, said working fluid circuit storage segment comprising a high pressure accumulator in fluid communication with said working fluid circuit operating segment intermediate said compressor and said flow restricting device, said connection including a liquid flow restricting device;

heating means in heat exchange relationship with a mixture storage portion of said high pressure accumulator; and means for sensing thermal demand disposed for selectively controlling said heating means.

3. A vapor compression cycle device comprising:

a closed working fluid circuit having an operating circuit and a storage segment, a miscible multi-component working fluid mixture in said circuit, with said components having different boiling points, said working fluid circuit operating segment comprising, serially connected, a compressor in flow communication with a condensing heat exchanger in flow communication with a condensing heat exchanger in flow communication with a flow restricting device in communication with an evaporating heat exchanger in flow communication with the input of said compressor, and a low pressure accumulator in flow communication with said operating segment disposed intermediate said flow restricting device and said input of said compressor, said working fluid circuit storage segment comprising a high pressure accumulator in fluid communication exclusively with said working fluid circuit operating segment intermediate said compressor and said flow restricting device, a means for varying the pressure in said high pressure accumulator and, a means for sensing thermal demand disposed to selectively control said pressure varying means.

4. A method for modulating and controlling the capacity of a vapor compression cycle device using a miscible multicomponent mixture with different boiling points as a working fluid in response to periods of increased or decreased heating or cooling demands comprising the steps of:

expanding said multicomponent working fluid mixture in a flow restricting device, evaporating at least a portion of the multicomponent mixture in an evaporating heat exchanger, while maintaining unevaporated mixture under low pressure, compressing the evaporated mixture and condensing at least a portion of said mixture in a condensing heat exchanger, withdrawing a portion of the mixture from the condenser heat exchanger substantially in vapor form and condensing said portion for storage as a liquid into a high pressure accumulator in fluid communication exclusively with a working fluid circuit operating segment intermediate a compressor and said flow restricting device, while heat from said condensation is allowed to dissipate from said accumulator and connecting segments, said accumulator having pressure varying means, and regulating the composition of the fluid in said working fluid circuit by withdrawing mixture substantially in vapor form for storage as a liquid in said accumulator during said periods of decreased demand by decreasing the pressure in said accumulator, and by forcing stored liquid mixture out of said accumulator during said periods of increased demand by increasing the pressure in said accumulator.

5. A method for modulating and controlling the capacity of a vapor compression cycle device using a miscible multicomponent mixture with different boiling points as a working fluid in response to periods of increased or decreased heating or cooling demands comprising the steps of:

expanding said multicomponent working fluid mixture in a flow restricting device, evaporating at least a portion of the multicomponent mixture in an evaporating heat exchanger, while maintaining unevaporated mixture under low pressure, compressing the evaporated mixture and condensing at least a portion of said mixture in a condensing heat exchanger, withdrawing a portion of the mixture from the condenser heat exchanger substantially in vapor form and condensing said portion for storage as a liquid into a high pressure accumulator in fluid communication exclusively with a working fluid circuit operating segment intermediate a compressor and said flow restricting device, while heat from said condensation is allowed to dissipate from said accumulator and connecting segments, said accumulator having pressure varying means, and regulating the composition of the fluid in said working fluid circuit by withdrawing mixture substantially in vapor form for storage as a liquid in said accumulator during said periods of decreased demand by decreasing the pressure in said accumulator, and by forcing stored liquid mixture out of said accumulator during said periods of increased demand by increasing the pressure in said accumulator where said increase in pressure is effected by an electric resistance heater.

6. A vapor compression cycle device comprising:

a closed working fluid circuit having an operating circuit and a storage segment, a miscible multicomponent working fluid mixture in said circuit with said components having different boiling points, said working fluid circuit storage segment comprising, serially connected, a compressor in flow communication with a condensing heat exchanger in flow communication with a flow restricting device in communication with an evaporating heat exchanger in flow communication with a low pressure accumulator in flow communication with the input of said compressor, said working fluid circuit storage segment comprising a high pressure accumulator in fluid communication exclusively with said working fluid circuit operating segment intermediate said compressor and said flow restricting device an electric resistance heater disposed in heat exchange relationship with a mixture storage portion of said high pressure accumulator, and a means for sensing thermal demand disposed to selectively control said pressure varying means.

7. A method of controlling the modulation of vapor compression cycle device capacity as in claim 4 in which the pressure in the high pressure accumulator is increased and decreased by varying the temperature of the mixture stored in said high pressure accumulator.

8. A method of controlling the modulation of vapor compression cycle device capacity as in claim 4 wherein the pressure in said high pressure accumulator is decreased by cooling the mixture stored in said high pressure accumulator.

9. A method for controlling the capacity modulation of a vapor compression cycle device as in claim 4 in which said mixture withdrawn for storage in said high pressure accumulator is withdrawn as a vapor.

10. A vapor compression cycle device as in claim 1 wherein said pressure varying means include a means include a means for cooling said mixture storage portion of said high pressure accumulator.

11. A vapor compression cycle device as in claim 1 wherein said high pressure accumulator is connected to a liquid bearing portion of said working fluid circuit.

12. A vapor compression cycle device as in claim 1 wherein said high pressure accumulator includes an inlet connected to a vapor bearing portion of said working fluid circuit.

13. A vapor compression cycle device as in claim 12 wherein said high pressure accumulator includes a liquid flow restricting device connected intermediate said mixture storage portion of said high pressure accumulator and said working fluid circuit active segment.

14. The method of claim 4 wherein the pressure varying means includes means for mechanically changing the volume of said high pressure accumulator thereby varying the pressure.

15. The method of claim 1 wherein the pressure varying means includes means for mechanically changing the volume of said high pressure accumulator thereby varying the pressure.

16. The method of claim 1 wherein the pressure in the high pressure accumulator is increased and decreased by varying the temperature of the mixture stored in said high pressure accumulator.

* * * * *